US010718077B2

(12) United States Patent
Kongo

(10) Patent No.: US 10,718,077 B2
(45) Date of Patent: Jul. 21, 2020

(54) SEWING MACHINE

(71) Applicant: JANOME SEWING MACHINE CO., LTD., Tokyo (JP)

(72) Inventor: Takeshi Kongo, Tokyo (JP)

(73) Assignee: JANOME SEWING MACHINE CO., LTD., Toyo (JP)

( * ) Notice: Subject to any disclaimer, the term of this patent is extended or adjusted under 35 U.S.C. 154(b) by 154 days.

(21) Appl. No.: 15/992,328

(22) Filed: May 30, 2018

(65) Prior Publication Data

US 2018/0363184 A1 Dec. 20, 2018

(30) Foreign Application Priority Data

Jun. 16, 2017 (JP) ..... 2017-118342

(51) Int. Cl.

| | |
|---|---|
| ***D05B 21/00*** | (2006.01) |
| ***D05B 19/16*** | (2006.01) |
| ***D05B 19/08*** | (2006.01) |
| ***D05C 9/22*** | (2006.01) |

(52) U.S. Cl.

CPC ..... *D05B 21/00* (2013.01); *D05B 19/08* (2013.01); *D05B 19/16* (2013.01); *D05C 9/22* (2013.01); *D05D 2205/02* (2013.01); *D05D 2205/085* (2013.01); *D05D 2205/18* (2013.01)

(58) Field of Classification Search

CPC ..... D05B 19/08; D05B 19/10; D05B 19/16; D05B 21/00; D05C 9/22

USPC ..... 700/136–138

See application file for complete search history.

(56) References Cited

U.S. PATENT DOCUMENTS

| | | | | |
|---|---|---|---|---|
| 4,998,489 | A * | 3/1991 | Hisatake | D05B 19/08 112/103 |
| 6,000,350 | A * | 12/1999 | Koike | D05B 19/10 112/102.5 |
| 6,032,594 | A * | 3/2000 | Komuro | D05B 19/08 112/102.5 |
| 6,167,822 | B1 * | 1/2001 | Miyasako | D05B 19/006 112/102.5 |
| 2008/0216721 | A1 * | 9/2008 | Nagai | D05B 19/10 112/102.5 |
| 2009/0043417 | A1 * | 2/2009 | Yamada | D05B 19/12 700/138 |
| 2013/0074748 | A1 * | 3/2013 | Kato | D05B 19/12 112/102.5 |

(Continued)

FOREIGN PATENT DOCUMENTS

| | | |
|---|---|---|
| JP | 2756694 B2 | 5/1998 |
| JP | 2000271359 A | 10/2000 |
| JP | 2001120867 A | 5/2001 |

*Primary Examiner* — Nathan E Durham

(74) *Attorney, Agent, or Firm* — Nath, Goldberg & Meyer; Jerald L. Meyer

(57) ABSTRACT

Provided is a sewing machine that enables a user to grasp the position of an interested point that is present inside and outside a stitchwork pattern without relying upon the user's imagination. This sewing machine includes an operation screen that displays, in a screen region, a frame image and a stitchwork image, and receives a user input of an interested point within a stitchwork frame displayed in the screen region. Moreover, the stitchwork frame is horizontally moved until a needle points out a point within the stitchwork frame and corresponding to the interested point input using the operation screen.

8 Claims, 15 Drawing Sheets

(56) References Cited

U.S. PATENT DOCUMENTS

| | | | | |
|---|---|---|---|---|
| 2013/0074749 | A1* | 3/2013 | Kato | D05B 19/02<br>112/102.5 |
| 2015/0152581 | A1* | 6/2015 | Abe | D05B 19/08<br>112/102.5 |

* cited by examiner

SEWING MACHINE

CROSS-REFERENCE TO RELATED APPLICATION

This application is based upon and claims the benefit of priority from Japan Patent Application No. 2017-118342, filed on Jun. 16, 2017, the entire contents of which are incorporated herein by reference.

FIELD OF THE INVENTION

The present disclosure relates to a sewing machine that includes a stitchwork frame.

BACKGROUND

Sewing machines form seams in accordance with stitchwork data, thereby sewing a stitchwork pattern on a sewing object. Such sewing machines hold the sewing object stretched by a stitchwork frame. The stitchwork frame moves horizontally along the plane of a bed unit, thereby changing the formation position of a seam. The operation procedures of forming a stitchwork pattern is described in the stitchwork data. For example, in the stitchwork data, the displacement amount of the stitchwork frame for reaching the next seam is described in sequence.

There are cases in which a check is desired for the relative position and range of the stitchwork pattern to be sewn in accordance with stitchwork data. More specifically, in relation to the stitchwork frame, there is a request to confirm that the stitchwork pattern is involved within the range of the stitchwork frame, or that there is no collision between a needle and the stitchwork frame. Moreover, in relation to the sewing object or the other pattern already sewn on the sewing object, there are cases in which a confirmation for a position where the stitchwork pattern is to be sewn is also desired.

In this case, a technology for tracing the range where the stitchwork is to be sewn has been proposed. For example, Japan Patent No. 2756694 B horizontally moves the stitchwork frame in such a way that the needle tip tracks a rectangular outline externally in contact with the stitchwork pattern. JP 2000-271359 A horizontally moves the stitchwork frame in such a way that the needle tip tracks a polygonal like octagon or circular outline that passes through the vertices of the stitchwork pattern. Moreover, J P 2001-120867 A horizontally moves the stitchwork frame in such a way that the needle moves along the entire circumference of the stitchwork pattern.

For example, it is assumed that a user wants to sew, on a table cloth, one flower attached to a cane from which multiple leaves extend. In addition, it is assumed that the pattern of a butterfly has been already sewn on this table cloth. Furthermore, it is assumed that the user wants to adjust the positional relationship between the flower pattern and the butterfly pattern in such a way that the butterfly is appeared to be stopping at the tip portion of a leaf within the flower pattern to be sewn.

This example indicates a case in which the user wants to grasp the position of the user's interested point present inside and outside the stitchwork pattern. When the technology of tracing the sewing range of the stitchwork is applied, although this technology enables the user to know the range, such a technology does not enable the user to know an arbitrary point, in order to grasp the positional relationship between the leaf tip and the butterfly, it is necessary for the user to first memorize the trajectory of the needle, compares the trajectory of needle with the flower attached to the cane from which multiple leaves extend, and to specify the position of the leaf tip on sewing object by comparison.

Such memorizing work, comparison work, and specifying work are carried out in sequence relying upon the user's imagination at all, and the user cannot grasp the positional relationships among the user's interested points present inside and outside the stitchwork pattern unless multiple times of imaginations are carried out in sequence. Hence, it is quite difficult for the user to grasp the positions of the user's interested point present inside and outside the stitchwork pattern, causing an error in grasping work in some cases, and not enabling the user to perform a sewing work with a high quality that can be satisfied by the user.

The present disclosure has been made in order to address the above technical problems of conventional technologies, and an object of the present disclosure is to provide a sewing machine that enables a user to grasp the position of an user's interested point that is present inside and outside a stitchwork pattern without relying upon the user's imagination.

SUMMARY OF THE INVENTION

In order to achieve the above objective, a sewing machine according to the present disclosure sews a stitchwork pattern on a sewing object, and the sewing machine includes:

a stitchwork frame horizontally moving along a direction in which a frame surface extends;

a needle bar supporting a needle to insert a thread, and reciprocally moving relative to an inner side of the stitchwork frame; and an operation screen displaying, in a screen region, an image of the stitchwork frame and an image of the stitchwork pattern, and receiving a user input of an interested point within the stitchwork frame displayed on the screen region, in which the stitchwork frame is horizontally moved until the needle points out a point within the stitchwork frame and corresponding to the interested point.

The above sewing machine may further include a jog key to receive a manual movement operation to the stitchwork frame, in which the operation screen may shift the image of the stitchwork pattern within the screen region in accordance with a displacement amount from the point in the stitchwork frame corresponding to the interested point to the point in the stitchwork frame and pointed out by the needle in accordance with the manual operation.

The above sewing machine may further include a calculating unit that calculates, based on the operation given to the jog key, the displacement amount from the point in the stitchwork frame and corresponding to the interested point to the point in the stitchwork frame and pointed out by the needle in accordance with the manual operation.

The above sewing machine may further include:

a stitchwork data memory storing stitchwork data containing a displacement amount from a last seam to a next seam; and an offset setting unit calculating the displacement amount, and adding the displacement amount to the position information on a first seam.

The sewing machine may further include a stitchwork data memory unit storing the stitchwork data and offset information that is the displacement amount calculated by the calculating unit, in which the stitchwork frame may be horizontally moved in accordance with the offset information, and be horizontally moved in synchronization with the reciprocal motion of the needle bar in accordance with the stitchwork data.

The operation screen may display a feature point on the image of the stitchwork pattern, and receives the feature point as the interested point.

The feature point may be a symbolic location that facilitates a user to grasp a position of the stitchwork pattern and a dimension thereof.

The feature point may be a leftmost end, a rightmost end, an uppermost end, or a lowermost end of the stitchwork pattern.

The above sewing machine may further include a feature point extracting unit extracting the feature point.

The operation screen may receive, as the interested point, a designation point on a screen touched by the user.

The operation screen may further display the image of the stitchwork frame in the screen region together with the image of the stitchwork pattern.

According to the present disclosure, the sewing machine enables the user to grasp the position of the user's interested point present inside and outside the stitchwork pattern without relying upon the user's imagination, thus providing a sewing result with a high quality that can be satisfied by the user.

DETAILED DESCRIPTION OF THE EMBODIMENTS (Structure)

Figure 1:
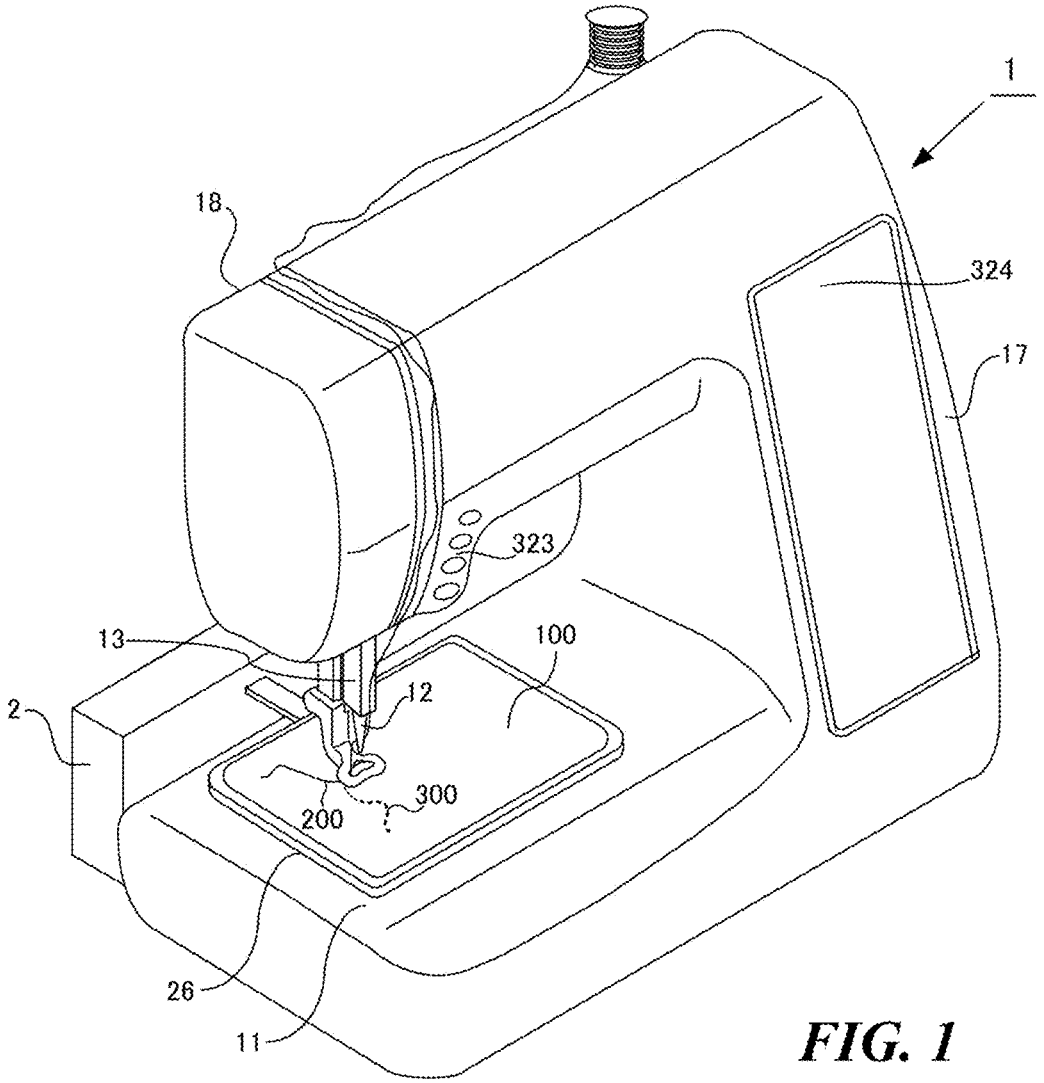
FIG. 1 is a diagram illustrating an entire structure of an external appearance of a sewing machine.

A sewing machine according to each embodiment of the present disclosure will be described in detail with reference to the figures. As illustrated in FIG. 1, a sewing machine 1 is a home-use, professional, or industrial machine that form a stitchwork on a sewing object 100. Example sewing objects 100 are cloths and leathers. The sewing machine 1 stretches the sewing object 100 across the upper plane of a bed unit 11, directs a needle 12 toward the sewing object 100 from an arm unit 18 that faces the bed unit 11, and inserts and removes the needle 12 relative to the sewing object 100, thereby forming a seam in the sewing object 100. The seam is formed by a needle thread 200 and a bobbin thread 300 intertwined with each other.

This sewing machine 1 includes a frame driving device 2. The frame driving device 2 horizontally moves a stitchwork frame 26 along the direction in which a frame surface extends above the bed unit 11. The stitchwork frame 26 supports the sewing object 100 within the frame so as to be stretched horizontally. The frame surface is a region surrounded by the frame. As the stitchwork frame 26 moves horizontally, the position where the needle 12 is inserted and removed on the sewing object 100, i.e., the formation position of a seam, is changed, and a stitchwork pattern that is a collection of seams are formed on the sewing object 100.

The sewing machine 1 is in a substantially C-shape that has a neck unit 17 standing upright from the end of the bed unit 11, and has the arm unit 18 extended in parallel with the bed unit 11 from the neck unit 17. An operation screen 324 is installed in the neck unit 17, enabling a display of the preparation status of sewing and status in sewing, and an input of the operation. Moreover, as for an input scheme of manual operation to the horizontal movement of the stitchwork frame, the sewing machine 1 includes jog keys 323 (see FIG. 4) that include vertical, horizontal, right and left buttons.

(Sewing Machine Body)

Figure 2:
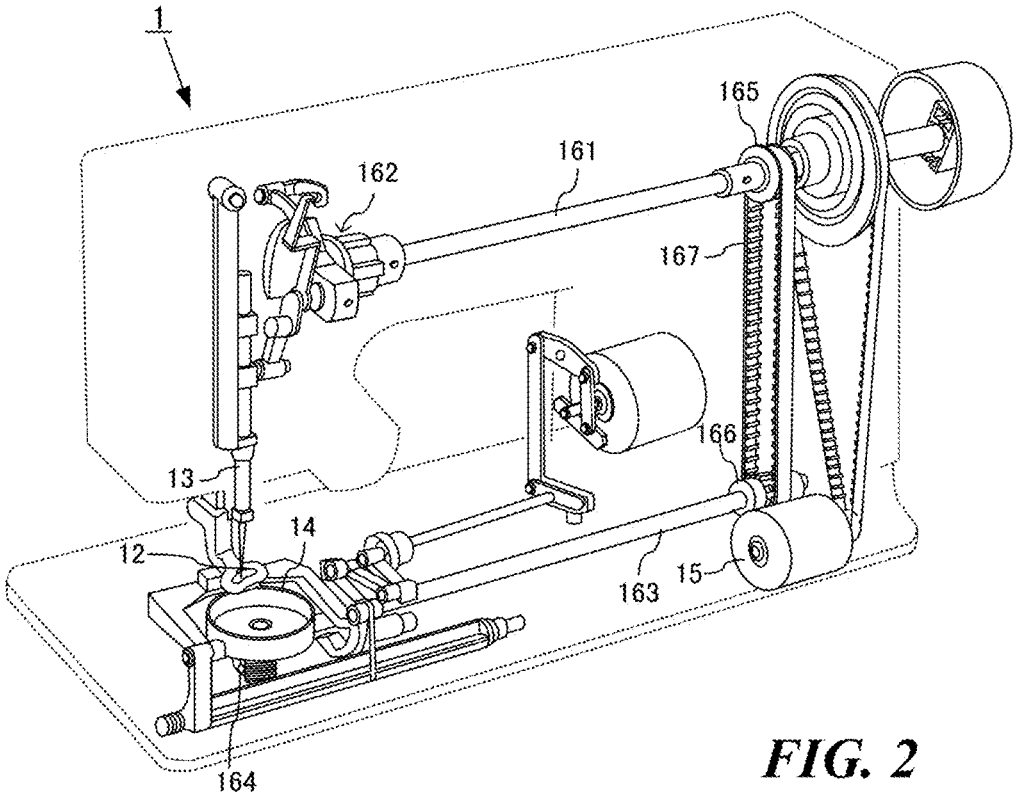
FIG. 2 is a diagram illustrating an internal structure of the sewing machine.

As illustrated in FIG. 2, the sewing machine 1 includes a needle bar 13 and a hook 14. The needle bar 13 extends vertically relative to the plane of the bed unit 11, and reciprocates in the axial direction. This needle bar 13 supports, at the tip located at the bed-unit-11 side, the needle 12 that holds the needle thread 200. The hook 14 is in a drum shape with a hollow interior and with an opened plane, is attached horizontally or vertically, and is turnable in the circumferential direction. In this embodiment, the hook 14 is attached horizontally. This hook 14 holds therein the bobbin around which the bobbin thread 300 is wound.

In this sewing machine 1, the needle 12 with the needle thread 200 penetrates the sewing object 100 by the vertical movement of the needle bar 13, and, when the needle 12 moves up, a needle-thread loop due to a friction between the sewing object 100 and the needle thread 200 is formed. Next, the needle-thread loop is trapped by the turning hook 14, and the bobbin that has supplied the bobbin thread 300 passes through the needle-thread loop along with the turning of the hook 14. Hence, the needle thread 200 and the bobbin thread 300 are intertwined with each other, and thus a seam is formed.

The needle bar 13 and the hook 14 are driven via respective transmission mechanisms with a common sewing-machine motor 15 being as a drive source. An upper shaft 161 extended horizontally is connected to the needle bar 13 via a crank mechanism 162. The crank mechanism 162 converts the rotation of the upper shaft 161 into linear motion, and transmits to the needle bar 13, and thus the needle bar 13 moves up and down. A lower shaft 163 extended horizontally is connected to the hook 14 via a gear mechanism 164. When the hook 14 is installed horizontally, the gear mechanism 164 is a cylindrical worm gear that has an axial angle of, for example, 90 degrees. The gear mechanism 164 converts the rotation of the lower shaft 163 by 90 degrees and transmits to the hook 14, and thus the hook 14 horizontally turns.

The upper shaft 161 is provided with a pulley 165 with a predetermined number of teeth. In addition, the lower shaft 163 is provided with a pulley 166 that has the same number of teeth as that of the pulley 165 of the upper shaft 161. Both the pulleys 165 and 166 are linked with each other via a toothed belt 167. When the upper shaft 161 rotates along with the rotation of the sewing-machine motor 15, the lower shaft 163 also rotates via the pulley 165 and the toothed belt 167. This enables the needle bar 13 and the hook 14 to operate synchronously.

(Frame Driving Device)

Figure 3:
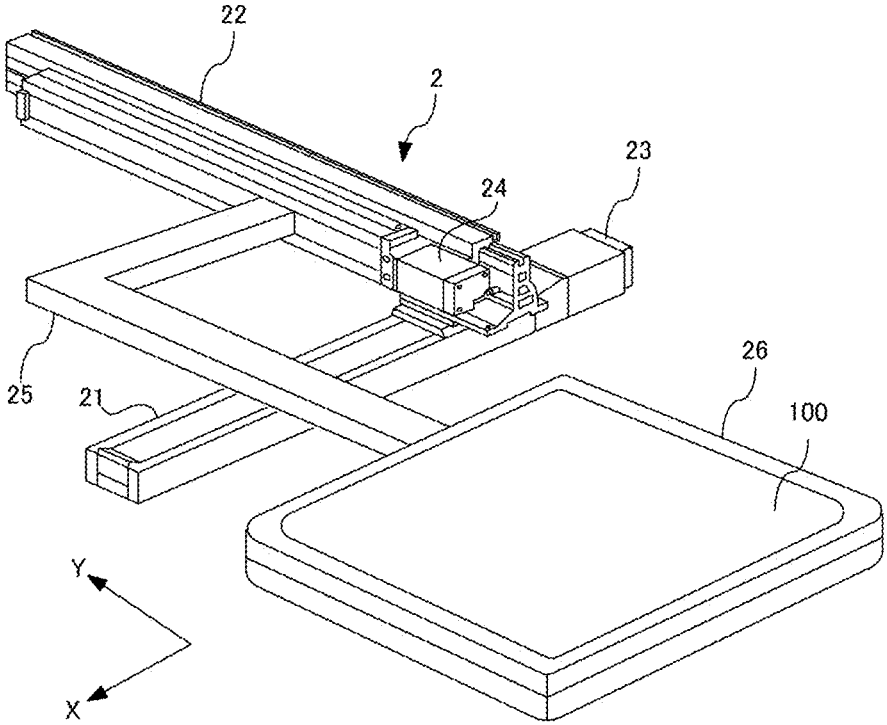
FIG. 3 is a diagram illustrating the detailed structure of a frame driving device.

As illustrated in FIG. 3, the frame driving device 2 is attachably fitted to the sewing machine 1, or is built in the sewing machine 1. The frame driving device 2 holds the stitchwork frame 26 by a stitchwork frame arm 25, and includes an X linear slider 21 that moves the stitchwork frame 26 in an X-axis direction, and a Y linear slider 22 that moves the stitchwork frame 26 in a Y-axis direction. The X-axis direction is a lengthwise direction of the bed unit 11, and is generally the right and left direction of the user, while the Y-axis direction is a widthwise direction of the bed unit 11, and is generally the back-and-forth direction of the user.

The stitchwork frame 26 includes an inner frame and an outer frame, holds and fastens the sewing object 100 between the inner frame and the outer frame by fitting the outer frame to the inner frame on which the sewing object 100 is placed. The sewing object 100 is located on the plane of the bed unit 11 so as to be movable horizontally along the fastened planar direction by the frame driving device 2.

(Control Device)

Figure 4:
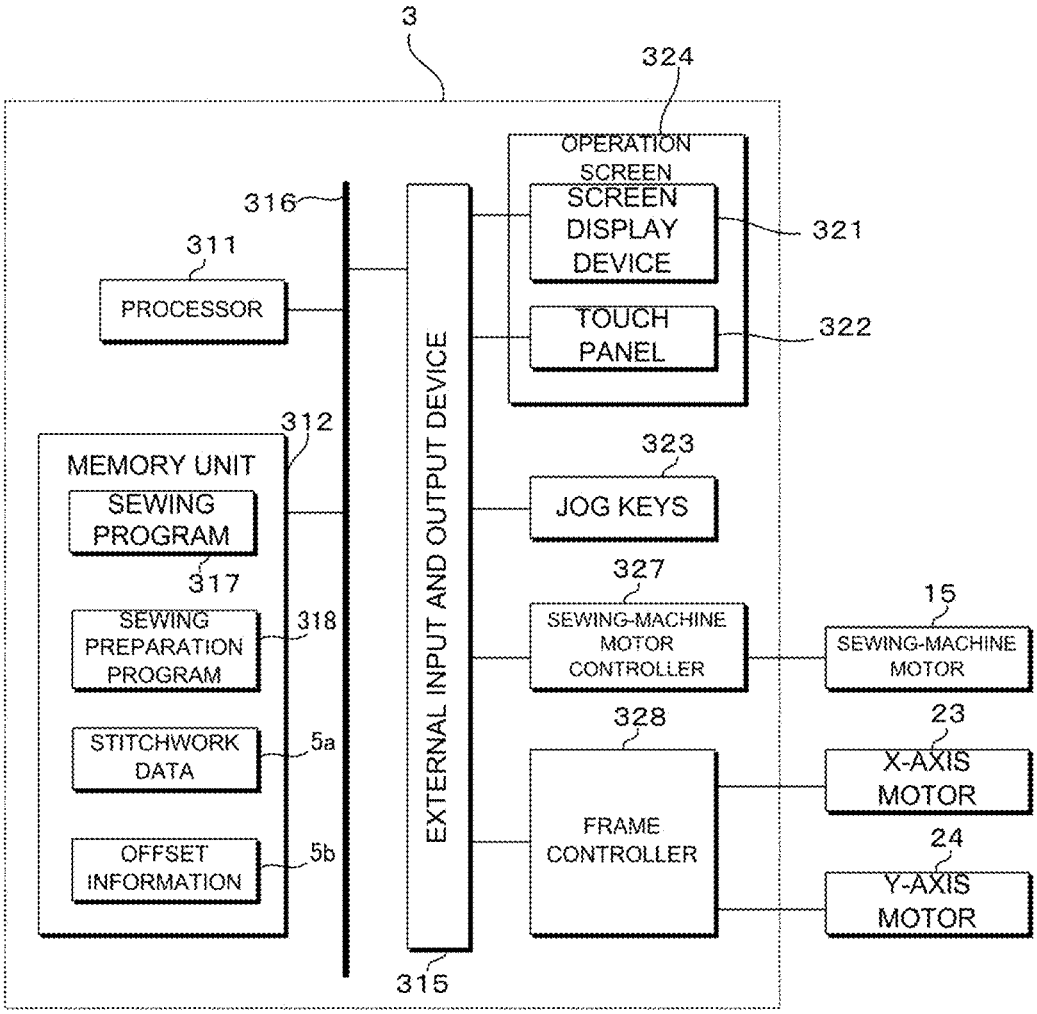
FIG. 4 is a block diagram illustrating a hardware structure of a control device for the sewing machine.

FIG. 4 is a block diagram illustrating a hardware structure of a control device 3 for the sewing machine 1. The control device 3 for the sewing machine 1 controls the horizontal movement of the stitchwork frame 26. The control device 3 is achieved by a so-called computer and peripheral controllers. The control device 3 includes a processor 311, a memory unit 312, and an external input and output device 315, those connected together via a bus 316. Moreover, the control device 3 includes, via the external input and output device 315, a screen display device 321, a touch panel 322, the jog keys 323, a sewing-machine motor controller 327, and a frame controller 328.

The memory unit 312 is an internal storage and a work area. The internal storage is a non-volatile memory that stores programs and data. The work area is a volatile memory where the programs and the data are expanded. The non-volatile memory is, for example, a hard disk, an SSD, or a flash memory. The volatile memory is a RAM. This memory unit 312 stores a sewing program 317, a sewing preparation program 318, and stitchwork data 5*a* and further stores offset information 5*b* depending on the user operation result.

The processor 311 is also called a CPU or an MPU, and decodes and executes the codes described in the sewing program 317 and the sewing preparation program 318. As the execution result, the processor 311 outputs a control signal through the external input and output device 315 like an I/O port. Moreover, a user operation signal is input into the processor 311 via the touch panel 322 and the jog keys 323.

The screen display device 321 includes a display controller, a depicting memory, and a liquid crystal display or an organic EL display, and displays display data transmitted from the processor 311 in a layout that is a format enabling a user to visually check, such as letter strings and figures. The touch panel 322 is a pressure-sensitive or electro-static type input device, and transmits a signal that indicates a touch position to the processor 311.

The screen display device 321 and the touch panel 322 are superimposed with each other and integrated with each other, serving as the operation screen 324 that has the screen display function and the touch operation function integrated with each other. The jog keys 323 are a set of buttons for respective directions that are up, down, right and left direction, and is a physical input device that transmits a signal in accordance with the user operation to the processor 311, or is icon keys within the touch panel 322 that are mainly utilized for manual operation to the stitchwork frame 26.

The sewing-machine motor controller 327 is connected to the sewing-machine motor 15 via signal lines. In response to a control signal from the processor 311, the sewing-machine motor controller 327 causes the sewing-machine motor 15 to rotate at the speed indicated by the control signal, or stops the sewing-machine motor 15.

The frame controller 328 is connected to an X-axis motor 23 of the frame driving device 2 and a Y-axis motor 24 thereof via signal lines. The X-axis motor 23 is the drive source of the X linear slider 21, while the Y-axis motor 24 is the drive source of the Y linear slider 22. In response to the control signal received from the processor 311, the frame controller 328 drives the X-axis motor 23 and the Y-axis motor 24 by a displacement amount indicated by the control signal. For example, the frame controller 328 transmits, to the X-axis motor 23 and the Y-axis motor 24 that are each a stepping motor, pulse signals in accordance with the target position and speed contained in the control signal.

Figure 5:
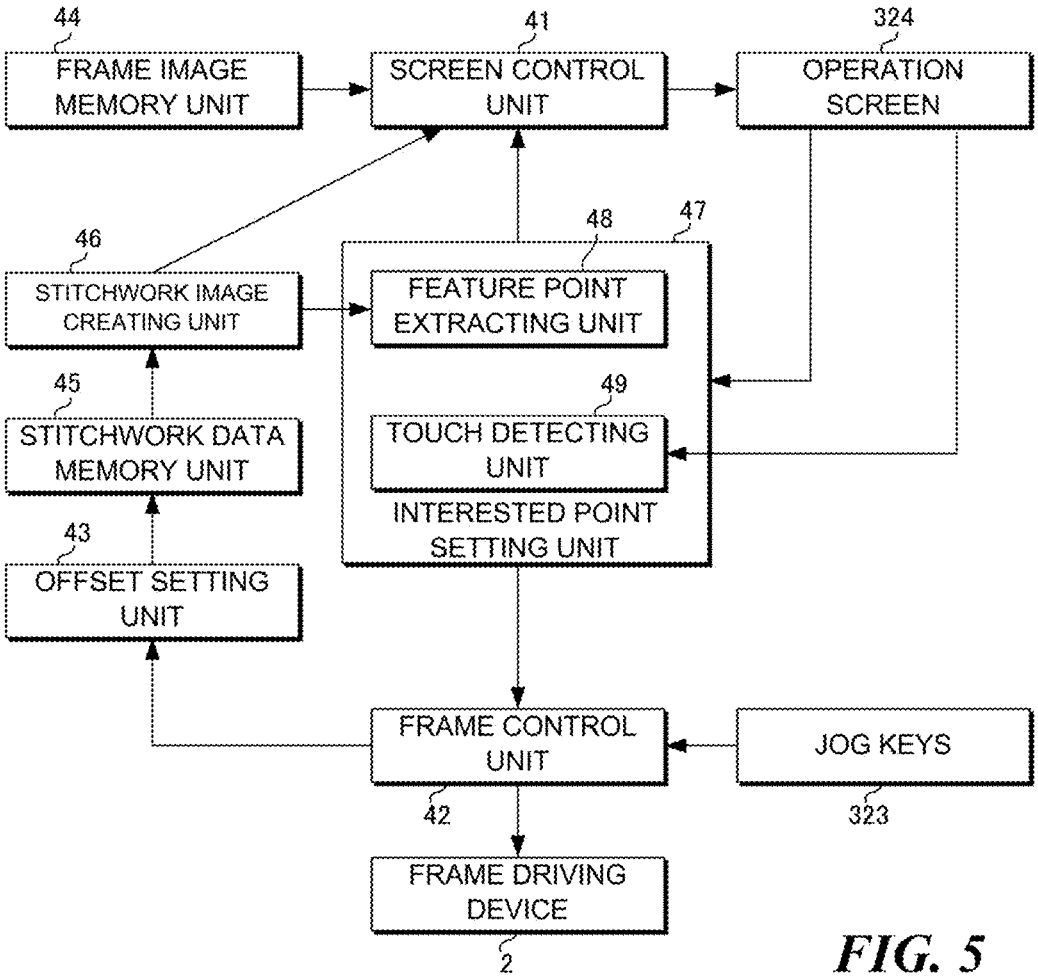
FIG. 5 is a block diagram illustrating a functional structure of the control device for the sewing machine.

FIG. 5 is a block diagram illustrating a structure of the control device 3 when executing the sewing preparation program 318. As illustrated in FIG. 5, the control device 3 includes a screen control unit 41, a frame control unit 42, and an offset setting unit 43. Moreover, as for providing various data to the screen control unit 41, the frame control unit 42, and the offset setting unit 43, the control device 3 further includes a stitchwork data memory unit 45, a stitchwork image creating unit 46, a frame image memory unit 44, and an interested point setting unit 47. The interested point setting unit 47 includes a feature point extracting unit 48 and a touch detecting unit 49.

(Screen Control Unit)

The screen control unit 41 mainly includes the processor 311. This screen control unit 41 controls the operation screen 324. The screen control unit 41 reproduces, on the operation screen 324, the stitchwork pattern to be formed in the stitchwork frame 26 together with the positional relationship between the stitchwork frame 26 and the stitchwork pattern.

Figure 6:
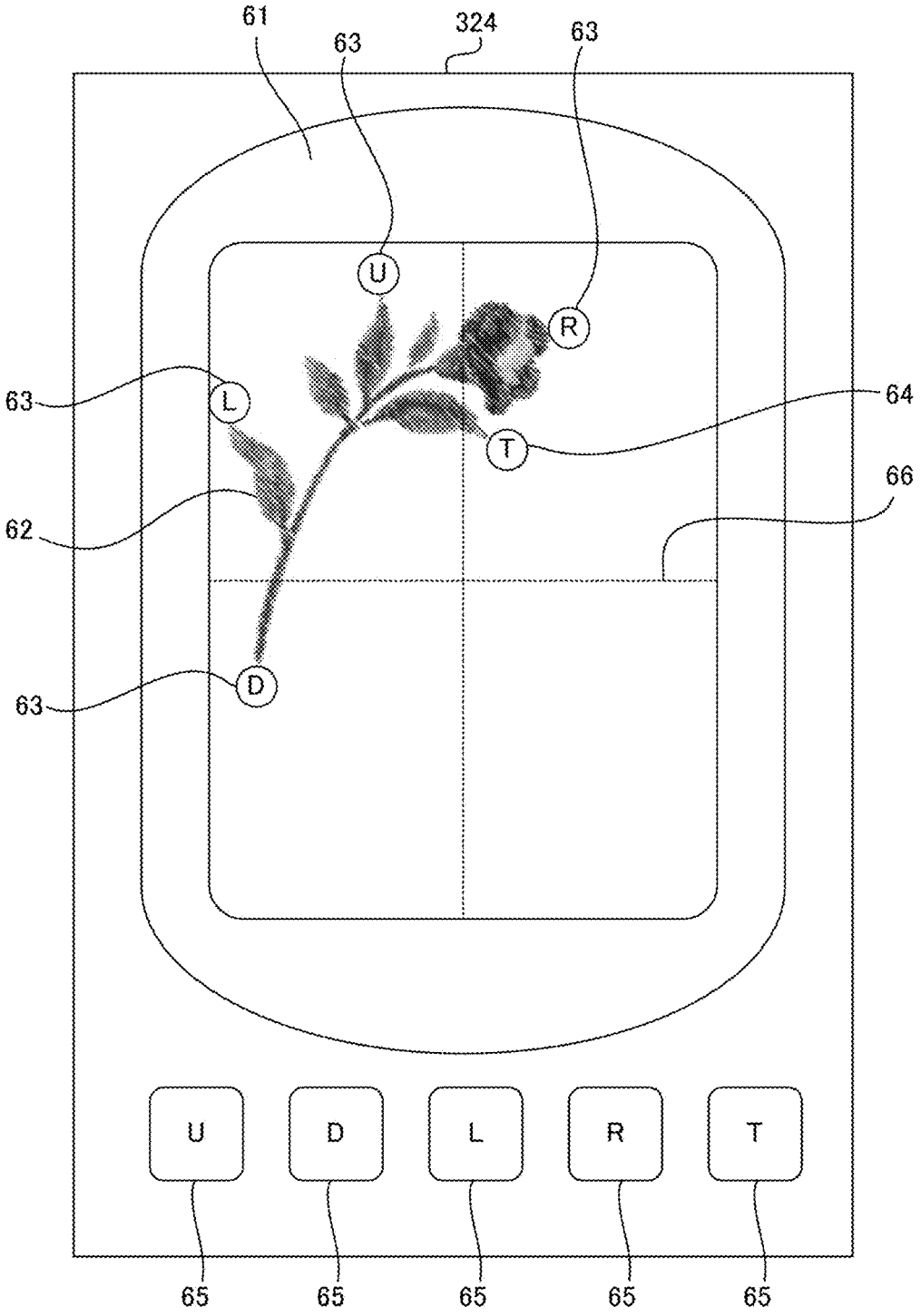
FIG. 6 is an exemplary diagram illustrating an operation screen for the sewing machine.

FIG. 6 is an exemplary diagram illustrating the operation screen 324. As illustrated in FIG. 6, the operation screen 324 displays a frame image 61 and a stitchwork image 62. The frame image 61 is an image of the stitchwork frame 26. The stitchwork image 62 is an image of the stitchwork pattern. The stitchwork image 62 is depicted within the frame of the frame image 61 in accordance with the positional relationship between the stitchwork pattern when actually sewn and the stitchwork frame 26, while the positional relationship to the stitchwork frame 26 and the dimension being reproduced. Depicted in the frame image 61 is a cross auxiliary line 66 for assisting the user to grasp the position of the stitchwork image 62.

The frame image memory unit 44 includes the memory unit 312. This frame image memory unit 44 stores data of the frame image 61. The screen control unit 41 reads the data of the frame image 61 from the frame image memory unit 44, and writes the read data in the depicting memory of the screen display device 321. The operation screen 324 displays the frame image 61 in accordance with the pixel information in the depicting memory. The frame image 61 and the stitchwork frame 26 have the consistent shape. By recognizing the stitchwork frame 26 at the sewing-machine-1 side, or accepting the user selection of the frame image 61, the image data corresponding to the stitchwork frame 26 is read.

The stitchwork image 62 is created from the stitchwork data 5*a*. The stitchwork data memory unit 45 mainly includes the memory unit 312. The stitchwork data 5*a* is stored in the stitchwork data memory unit 45. The stitchwork image creating unit 46 that mainly includes the processors 311 renders the stitchwork image 62 in accordance with this stitchwork data 5*a*.

Figure 7:
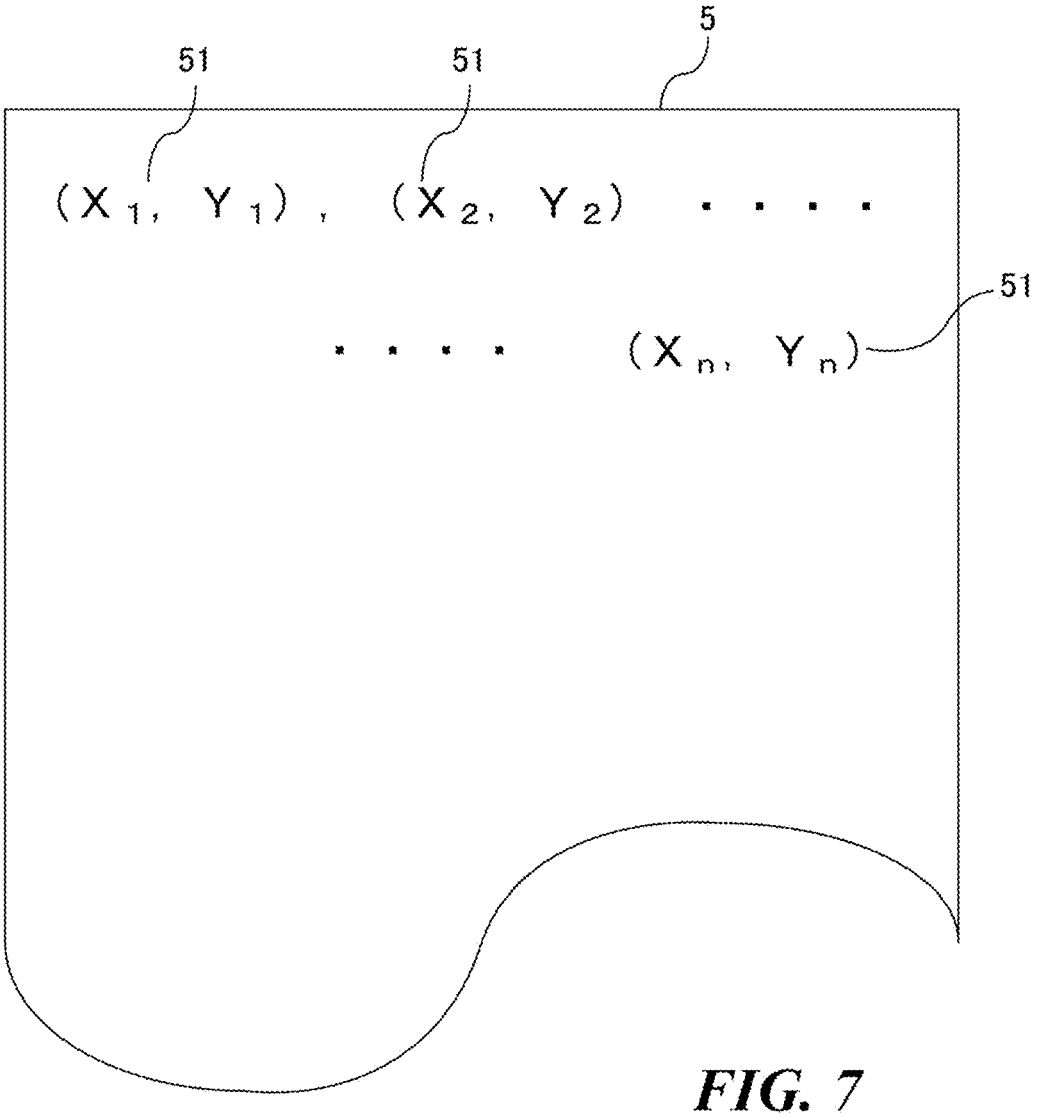
FIG. 7 is an exemplary diagram illustrating stitchwork data.

In general, the rendering method is as follows. First, as illustrated in FIG. 7, seam position information 51 are arranged in the stitchwork data 5*a* in the sewing sequence. The position information 51 is indicated by the relative positional coordinate with reference to the last seam. That is, the position information 51 on the n-th seam (where n is a positive integer, such as n=1, 2, 3, . . . ) is expressed by an X-axis direction displacement amount and a Y-axis direction displacement amount from the (n−1)th seam. The position information 51 indicating the first seam is expressed by the displacement amount from the origin. The origin is, for example, the center of the stitchwork frame 26. Thus, in addition to the shape and dimension of the stitchwork pattern, the stitchwork data 5*a* also contains the information on the position of the stitchwork pattern relative to the stitchwork frame 26.

Next, the stitchwork image creating unit 46 expands the stitchwork data 5*a* in the work memory, and converts this stitchwork data 5*a* into an absolute positional coordinate. The absolute coordinate of a seam is acquired by adding all the position information 51 up to this seam. Here, it is assumed that the origin coordinate is (X0, Y0). Moreover, the position information 51 on the first seam is (X1, Y1). The stitchwork image creating unit 46 converts the positional coordinate of the first seam into (X0+X1, Y0+Y1). Moreover, the X coordinate of the n-th seam is converted into the sum of the X coordinate of the origin and the X-axis direction displacement amounts of respective seams up to the n-th seam. The Y coordinate of the n-th seam is converted into the sum of the Y coordinate of the origin and the Y-axis direction displacement amounts of respective seams up to the n-th seam.

In this case, when the stitchwork data memory unit 45 stores the offset information 5*b*, the stitchwork image creating unit 46 shifts the position of the stitchwork image 62 by the offset information 5*b*. The offset information 5*b* indicates the direction and distance for shifting the sewing position of the stitchwork pattern, and contains an X-axis direction offset value Xet and a Y-axis direction offset value Yet. The stitchwork image creating unit 46 further adds the offset information 5*b* to each position information 51 on the stitchwork data 5*a* having undergone absolute position coordinate conversion.

Furthermore, the stitchwork image creating unit 46 converts the absolute positional coordinate of a seam into the coordinate system on the operation screen 324 from the coordinate system of the stitchwork frame 26. The screen control unit 41 changes the format of the stitchwork image 62 expressed by the coordinate system of the operation screen 324 into a bitmap format, and writes the bitmap image in the depicting memory. The operation screen 324 displays the stitchwork image 62 inside the frame image 61 in accordance with the pixel information in the depicting memory.

As illustrated in FIG. 6, the operation screen 324 further displays feature point markers 63. The feature point markers 63 are each a drawing like a circle that indicates the feature point of the stitchwork pattern. The feature point is a symbolic point of identifying the position of the stitchwork pattern. For example, the feature point is the uppermost end, lowermost end, rightmost end or leftmost end of the stitchwork pattern. These feature points are extracted by the feature point extracting unit 48 that mainly includes the processor 311.

The feature point extracting unit 48 extracts the feature point by analyzing the stitchwork image 62. The seam with the smallest coordinate value in the Y-axis direction that is the axis of the vertical direction is a feature point at the uppermost end. Moreover, the seam with the largest coordinate value in the X-axis coordinate that is the axis of the horizontal direction is a feature point at the rightmost end. The feature point extracting unit 48 stores, in the reserved memory area, the positional coordinate of the feature point. The screen control unit 41 writes the feature point marker 63 at the position of the feature point in the depicting memory. The operation screen 324 displays the feature point marker 63 on the feature point of the stitchwork image 62 in accordance with the pixel information in the depicting memory.

Moreover, as illustrated in FIG. 6, the operation screen 324 further displays a user designation point marker 64. The user designation point marker 64 is a drawing like a circle that indicates a point designated by the user. The touch detecting unit 49 mainly includes the touch panel 322 and the processor 311, detects a touch operation, and informs the screen control unit 41 of the touch position. The screen control unit 41 displays the user designation point marker 64 on the informed touch position. The touch detecting unit 49 converts the user designated point into the coordinate system of the stitchwork frame 26 from the coordinate system of the operation screen 324, and stores the conversion result in the reserved memory area.

The above feature point and user designation point that are indicated by the feature point marker 63 and the user designation point marker 64 are user's interested points. The feature point extracting unit 48 specifies, prior to the user, the candidate that possibly becomes the user's interested point. The user designation point is restricted within the frame image 61. As long as the touch point is within in the frame image 61, the touch detecting unit 49 informs the screen control unit 41 of the user designation point, and stores the position of the user designation point.

Figure 8:
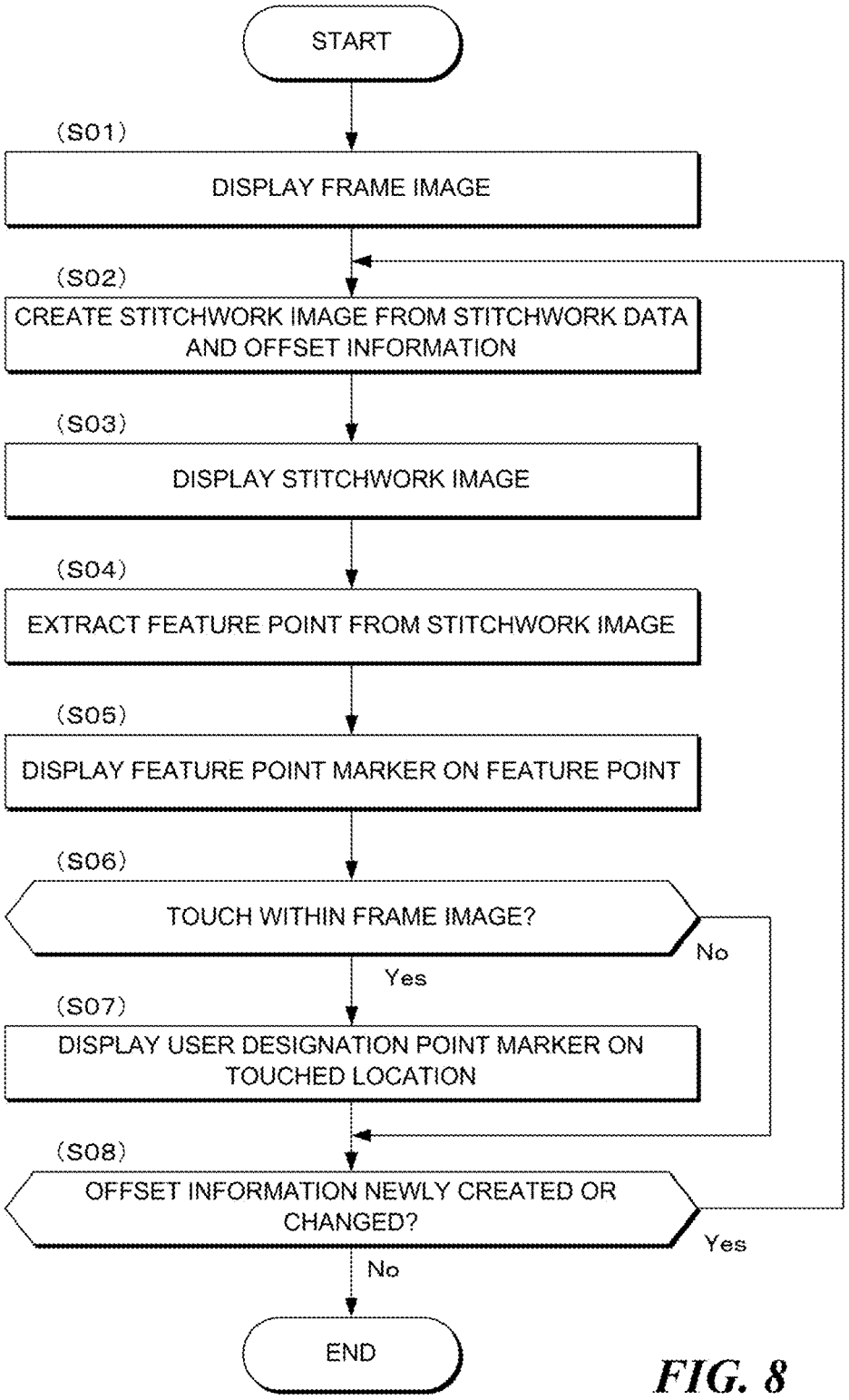
FIG. 8 is a flowchart illustrating a control operation for the operation screen.

FIG. 8 is a flowchart illustrating the example control operation for the operation screen 324 by the screen control unit 41. First, the screen control unit 41 reads the image data of the frame image 61, and displays the image data on the operation screen 324 (step S01). Next, the stitchwork image creating unit 46 creates the image data of the stitchwork image 62 from the stitchwork data 5*a* (step S02). At this time, when there is also the offset information 5*b*, the image data of the stitchwork image 52 is created also in accordance with the offset information 5*b*. The screen control unit 41 displays the created stitchwork image 62 on the operation screen 324 (step S03).

The feature point extracting unit 48 extracts the feature point from the stitchwork image 62 (step S04). The image control unit displays the feature point marker 63 on the extracted feature point (step S05). Moreover, when the touch detecting unit 49 detects a touch within the frame image 61 (step S06: YES), the screen control unit 41 displays the user designation point marker 64 on the touched location (step S07).

Moreover, when the offset information 5*b* is newly created or updated as will be described later (step S08: YES), the process returns to the step S02, and the new image data of the stitchwork image 62 having undergone the position shifting in accordance with the offset information 5*b* is created (step S02) and the stitchwork image 62 is displayed again (step S03).

(Frame Control Unit)

The frame control unit 42 mainly includes the processor 311 and the frame controller 328. The frame control unit 42 controls the movement of the stitchwork frame 26. First, the frame control unit 42 keeps horizontally moving the stitchwork frame 26 until the needle 12 points out the interested point. The user designates, by using the operation screen 324, the interested point at which pointing out by the needle 12 is carried out.

As illustrated in FIG. 6, below the frame image 61, frame moving buttons 65 for each interested point indicated by each feature point marker 63 and user designation point marker 64 are arranged. This frame moving button 65 is a selecting unit that receives a user selection of the feature point marker 63 or the user designation point marker 64, and when the user depresses any of the frame moving buttons 65 by a touch operation, the frame control unit 42 moves the stitchwork frame 26 in such a way that the needle 12 is located at the interested point indicated by the depressed frame moving button 65. That is, the frame control unit 42 accepts the coordinate value of the interested point designated by the user as the displacement amount in the X-axis direction and Y-axis direction, and moves the stitchwork frame 26 in accordance with the displacement amount.

Secondly, the frame control unit 42 moves the stitchwork frame 26 in response to the operation to the jog keys 323. The frame control unit 42 moves the stitchwork frame 26 so as to match the information indicating the operation direction and the operation amount both input from the jog keys 323. When, for example, the upper direction button is depressed by n times, the stitchwork frame 26 is moved in the Y-axis direction that is a direction in which the coordinate value decreases by Y1 λn mm. When the right direction button is depressed by m times, the stitchwork frame 26 is moved in the X-axis direction that is a direction in which the coordinate value increases by X1×m mm. Furthermore, when the upper direction button is kept being depressed, the stitchwork frame 26 is moved in the Y-axis direction that is a direction in which the coordinate value is decreased by distance proportional to the depressing time.

Figure 9:
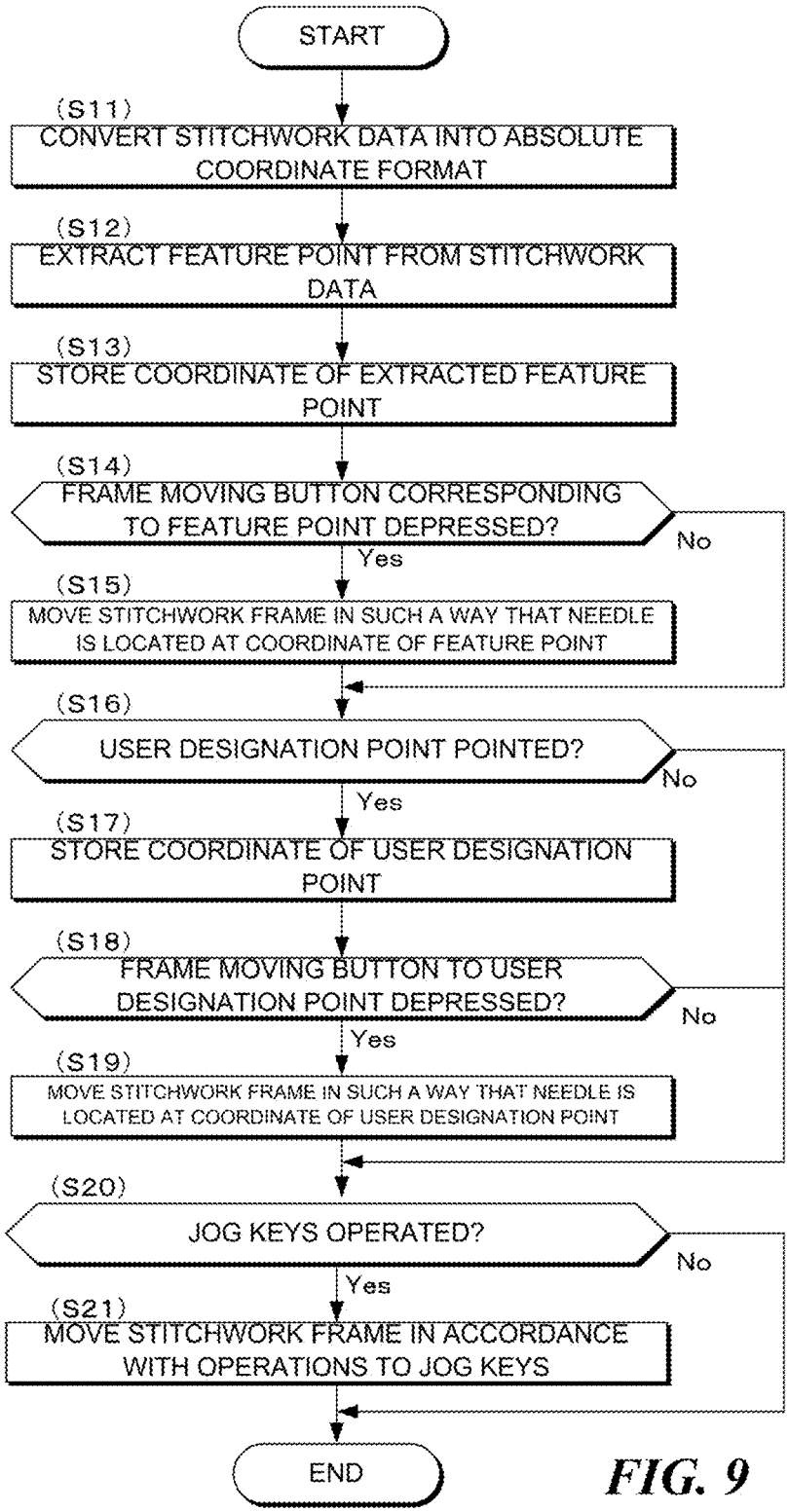
FIG. 9 is a flowchart illustrating a control operation for the stitchwork frame.

FIG. 9 is a flowchart illustrating the frame control operation by such a frame control unit 42. First, the stitchwork image creating unit 46 converts the stitchwork data 5*a* into the format of an absolute coordinate (step S11), and the feature point extracting unit 48 extracts the feature point from the stitchwork data 5*a* in the absolute coordinate format (step S12). The interested point setting unit 47 temporarily stores the coordinate of this feature point (step S13).

When the frame moving button 65 to the feature point displayed on the operation screen 324 is depressed using the touch panel 322 (step S14: YES), the frame control unit 42 moves the stitchwork frame 26 in such a way that the needle 12 is located at the coordinate of the feature point indicated by the depressed button (step S15).

When the user designation point is designated using the touch panel 322 (step S16: YES), the interested point setting unit 47 temporarily stores the coordinate of the user designation point (step S17). Next, when the frame moving button 65 to the user designation point displayed on the operation screen 324 is depressed using the touch panel 322 (step S18: YES), the stitchwork frame 26 is moved in such a way that the needle 12 is located at the coordinate of the user designation point (step S19).

Furthermore, when the user operates the jog keys 323 (step S20: YES), the stitchwork frame 26 is moved by the same direction and amount as the operation direction and the operation amount of the jog keys 323 (step S21).

(Offset Setting Unit)

The offset setting unit 43 includes the processor 311. This offset setting unit 43 creates the offset information 5*b* for changing the position of the stitchwork pattern in accordance with the operation given to the jog keys 323. For example, a movement of the stitchwork frame 26 that causes the needle 12 to point out the interested point will be defined as a first condition, while further movement of the stitchwork frame 26 in accordance with the operation given to the jog keys 323 will be defined as a second condition. When these first condition and second condition are satisfied in sequence, the offset setting unit 43 creates the offset information 5*b* in accordance with the operation given to the jog keys 323, and stores this offset information 5*b* in the stitchwork data memory unit 45.

The offset information 5*b* matches the difference in positions of two points pointed out by the needle 12 before and after the manual operation given to the jog keys 323. Before the operation given to the jog keys 323, the needle 12 points out the interested point of the feature point or the user designated point. The offset setting unit 43 calculates, as a calculating unit, the difference between the interested point pointed out by the needle 12 and the point pointed out by the needle 12 after the operation is given to the jog keys 323. That is, the offset setting unit 43 calculates the distance in the X-axis direction and the distance in the Y-axis direction in which the stitchwork frame 26 is moved before and after the operation given to the jog keys 323. Simply, the operation amount given to the jog keys 323 may be counted. Next, the offset setting unit 43 stores the offset information 5*b* that is this difference in the stitchwork data memory unit 45.

Figure 10:
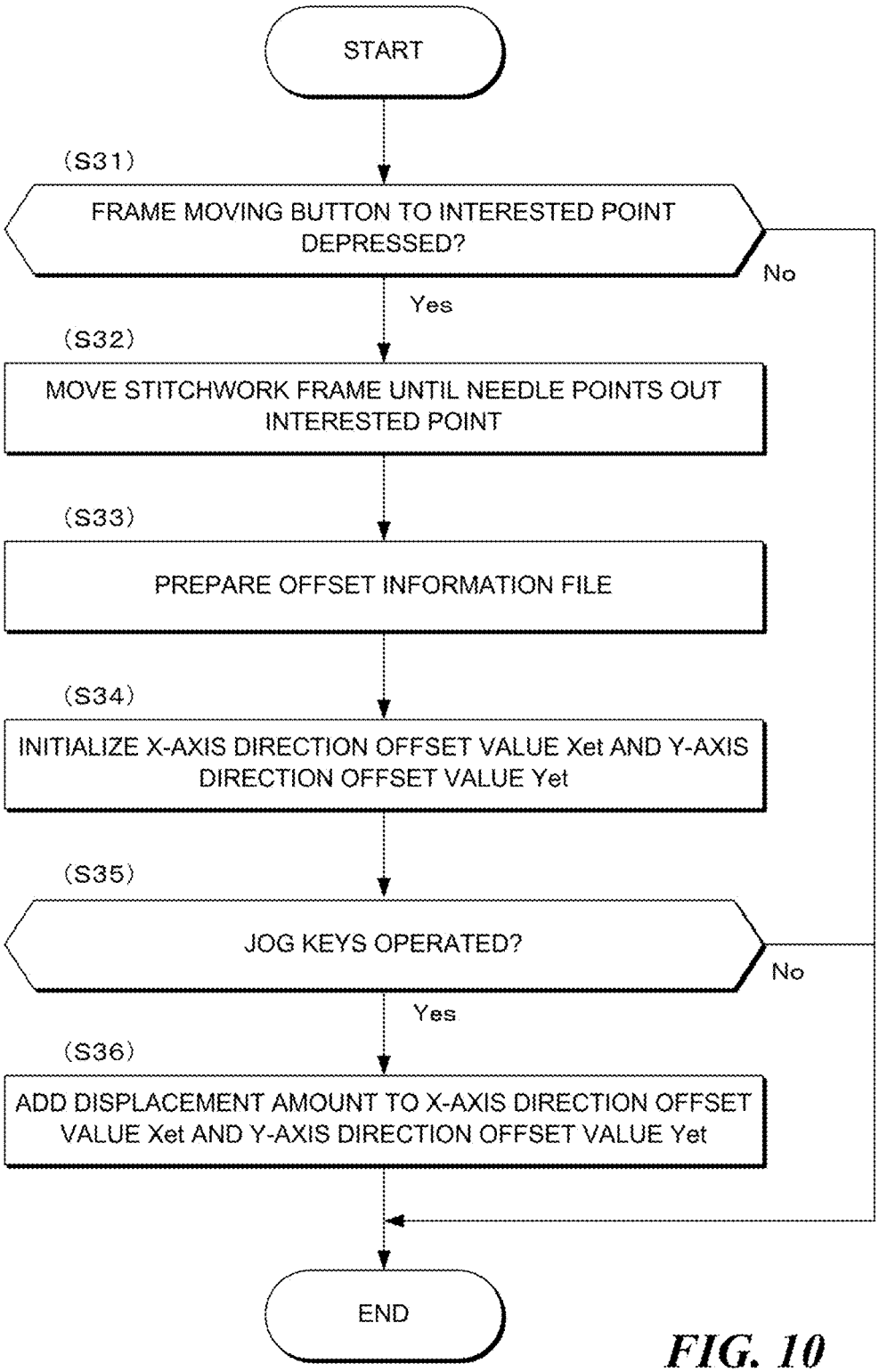
FIG. 10 is a flowchart illustrating a creation operation of offset information.

FIG. 10 is a flowchart illustrating a creation operation of the offset information 5*b* by the offset setting unit 43. First, when the frame moving button 65 that corresponds to the interested point displayed on the operation screen 324 is depressed using the touch panel 322 (step S31: YES), the stitchwork frame 26 is moved until the needle 12 points out the interested point determined by the user by this button depression (step S32).

After this step S32, the offset setting unit 43 prepares the file of the offset information 5*b* (step S33), and initializes the X-axis direction offset value Xet and the Y-axis direction offset value Yet both in the file of this offset information 5*b* to zero (S34). When the user operates the jog keys 323 (step S35), the offset setting unit 43 adds the displacement amount in the X-axis direction in which the stitchwork frame 26 is moved in accordance with the operation given to the jog keys 323 to the X-axis direction offset value Xet, and adds the displacement amount in the Y-axis direction to the Y-axis direction offset value Yet (Step S36).

Buttons for confirming the offset and for cancelling may be prepared in the operation screen 324, and the offset setting unit 43 may store, in the stitchwork data memory unit 45, the file of the created offset information 5*b* when the button for confirming the offset is depressed, and may discard the created offset information 5*b* without storing such information in the stitchwork data memory unit 45 when the button for cancelling is depressed.

(Action)

Figure 11A:
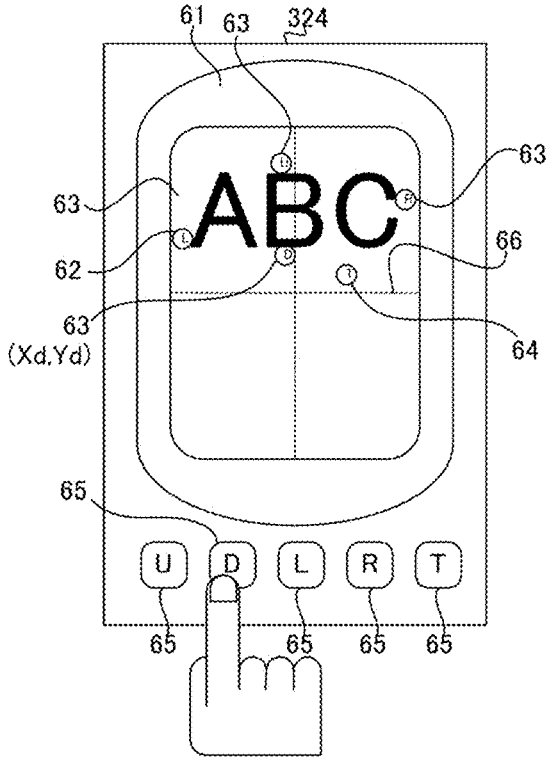
FIGS. 11A and 11B are each an explanatory diagram illustrating the relationship between a feature point depression and a stitchwork frame movement in the operation screen.

The action of the above sewing machine 1 will be described in detail. As illustrated in FIG. 11A, the operation screen 324 of the sewing machine 1 displays the stitchwork image 62 in the frame image 61. The operation screen 324 displays the stitchwork image 62 and the frame image 61 with the positional relationship between the stitchwork pattern when actually formed on the sewing object 100 in accordance with the stitchwork data 5*a* and the stitchwork frame 26. Hence, the user can grasp the positional relationship between the stitchwork frame 26 and the actual stitchwork pattern in accordance with the stitchwork data 5*a* based on the stitchwork image 62 and the frame image 61.

Figure 11B:
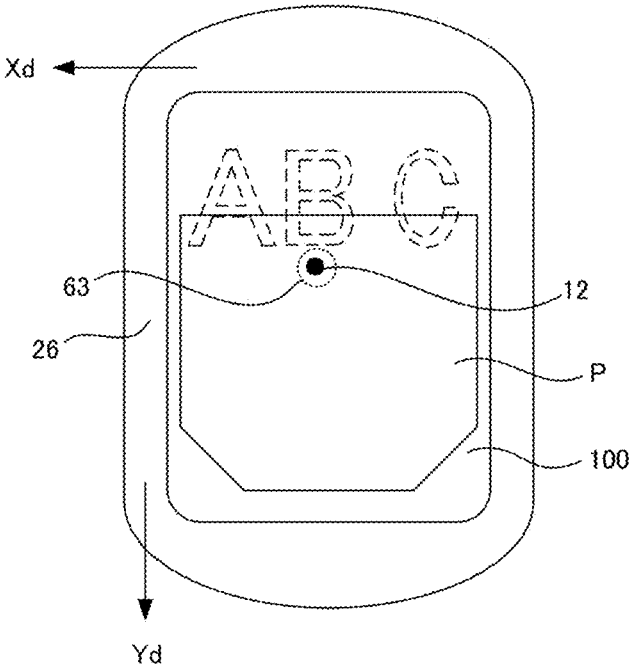

As illustrated in FIG. 11B, when the frame moving button 65 for the feature point is depressed, the stitchwork frame 26 is horizontally moved until the needle 12 points out this feature point. With reference to this feature point, the user can understand the position of the stitchwork pattern on the sewing object 100. That is, the positional relationship among the stitchwork frame 26, the stitchwork pattern, and the sewing object 100 can be grasped even before the sewing by the operation screen 324 that displays the frame image 61 and the stitchwork image 62, and the stitchwork frame 26 that is horizontally moved until the needle 12 points out the feature point.

As illustrated in FIG. 11B, it is assumed that the stitchwork data 5*a* on a letter string of A, B, and C alphabets is stored in the stitchwork data memory unit 45. Moreover, the frame moving button 65 to the lowermost end is depressed. Hence, the stitchwork frame 26 is moved until the needle 12 points out the lowermost end of the letter string of A, B, and C alphabets. At this time, since the setting of the stitchwork frame 26 relative to the sewing object 100 is not appropriate, the lowermost end of the letter string of A, B, and C alphabets overlaps a pocket P of the sewing object 100. The user may correct the stitchwork data 5*a*, or set again the sewing object 100 on the stitchwork frame 26.

Figure 12A:
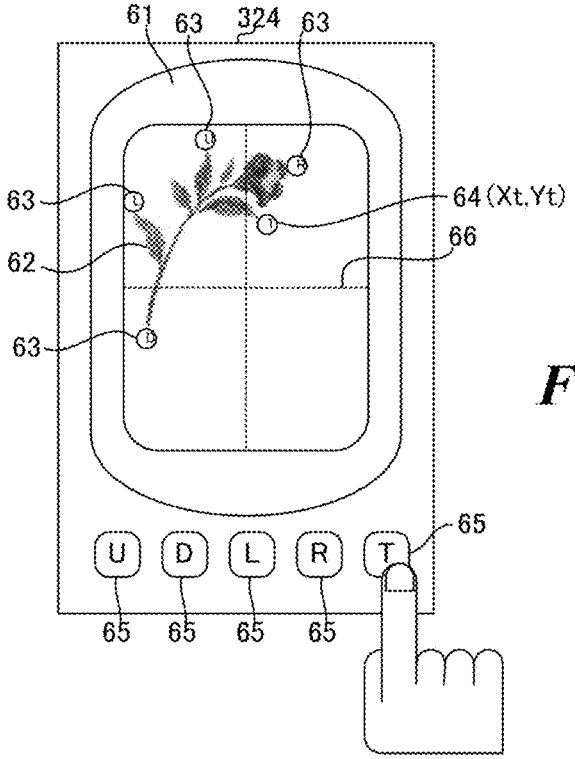
FIGS. 12A and 12B are each an explanatory diagram illustrating the relationship between a designation of an interested point and a stitchwork frame movement in the operation screen.

Next, it is assumed that, for example, the stitchwork data 5*a* of a flower attached to a cane from which multiple leaves are extended is stored in the stitchwork data memory unit 45. As illustrated in FIG. 12A, the operation screen 324 displays the stitchwork image 62 of this flower. In this case, it is assumed that the user wants to dispose the stitchwork pattern of the flower in such a way that a butterfly B already sewn is located under this flower.

Figure 12B:
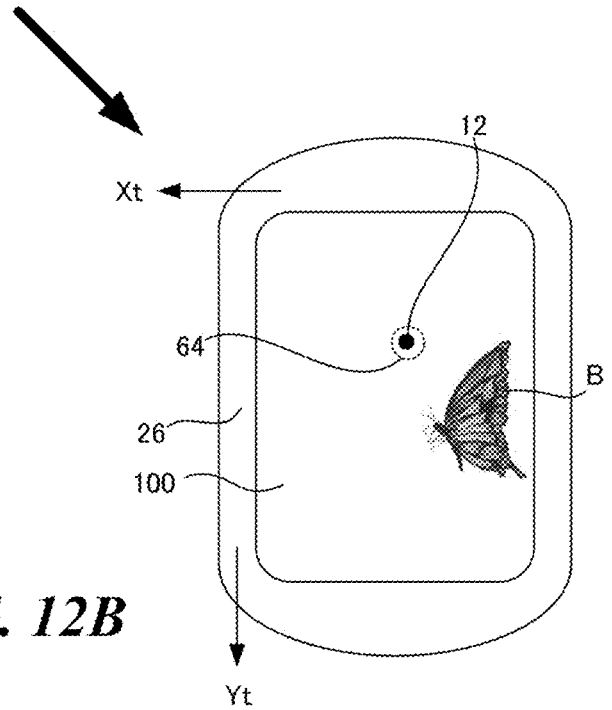

After the tip of leaf present under this flower is touched by the user and the user designation point marker 64 is displayed, the frame moving button 65 is depressed which sets the user designation point indicated by the user designation point marker 64 as the interested point. In this case, as illustrated in FIG. 12B, when sewing is performed in accordance with the stitchwork data 5*a*, the stitchwork frame 26 is horizontally moved in such a way that the needle 12 points out the tip of leaf present under the flower. This enables the user to grasp the positional relationship between the user designation point that is the tip of leaf and the butterfly B.

Figure 12C:
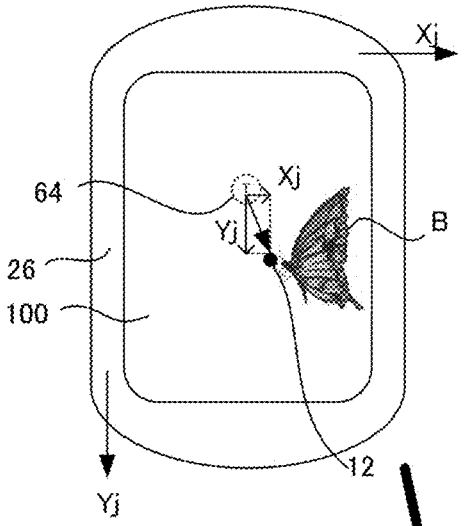
FIGS. 12C to 12E are each an explanatory diagram illustrating a jog key operation after the interested point is designated.

The user can understand that the user designation point set under the flower is apart from the butterfly B already sewn, and it is assumed that the user wants to move the flower in such a way that the butterfly B is located at the tip of leaf. As illustrated in FIG. 12C, after the interested point is pointed out by the needle 12 by the depression of the frame moving button 65, the jog keys 323 are operated until the needle 12 is located at the point to which the interested point is desirably moved.

Figure 12D:
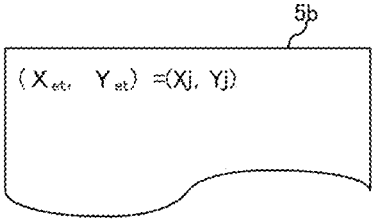
Figure 12E:
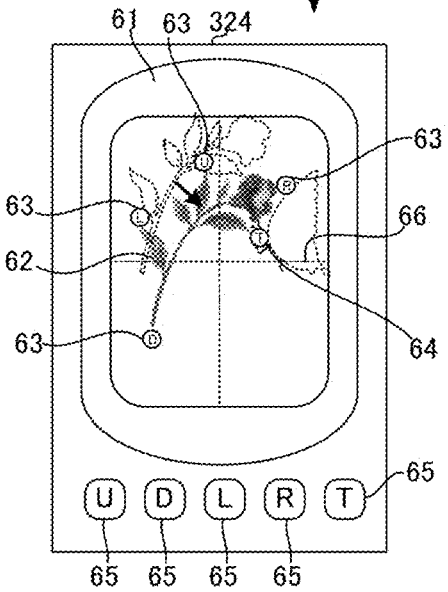

In this case, the stitchwork data 5*a* on the flower is edited in such a way that the butterfly is located under the flower. That is, by the operation to the jog keys 323, the position pointed out by the needle 12 is changed to the nearby location to the butterfly from the location under the flower that is the interested point. As illustrated in FIG. 12D, an X-axis direction component Xj and a Y-axis direction component Yj in this change amount are added to the X-axis direction offset value Xet and the Y-axis direction offset value Yet both in the offset information 5*b*. Accordingly, as illustrated in FIG. 12E, the operation screen 324 displays the stitchwork image 62 of the flower shifted by what corresponds to the amount indicated by the offset information 5*b*.

Figure 13A:
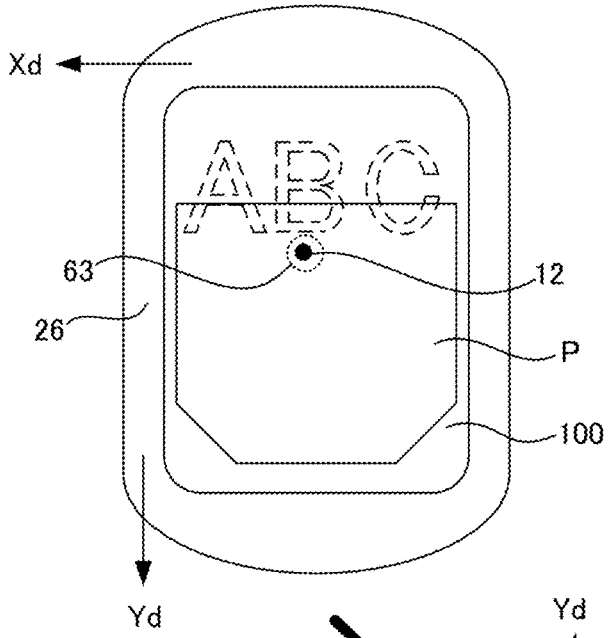
FIGS. 13A to 13C are each an explanatory diagram illustrating a jog key operation after a feature point is designated.

Moreover, as illustrated in FIG. 13A, it is assumed that the frame moving button 65 with reference to the lowermost end of the letter string of A, B, and C alphabets are depressed. Hence, the stitchwork frame 26 keeps moving until the needle 12 points out the lowermost end of the letter string of A, B, and C alphabets. At this time, it is assumed that since the setting to the stitchwork frame 26 of the sewing object 100 is not accurate, the lowermost end of the letter string of A, B, and C alphabets overlaps the pocket of the sewing object 100.

Figure 13B:
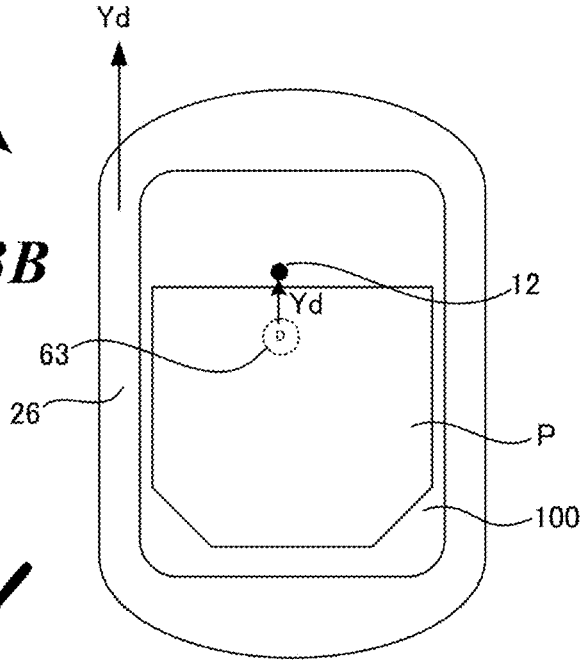
Figure 13C:
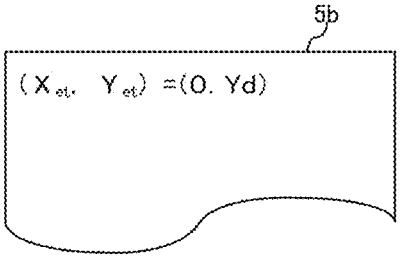

Hence, as illustrated in FIG. 13B, the user operates the jog keys 323, and moves the stitchwork frame 26 until the needle 12 goes over the upper edge of the pocket. In this case, the stitchwork data 5*a* is changed in such a way that the letter string of A, B, and C alphabets is to be sewn so as to be apart from the pocket. That is, as illustrated in FIG. 13C, the displacement amounts (0, Yd) in the X-axis direction and in the Y-axis direction from the lowermost end of the letter string of A, B, and C alphabets to the position pointed out by the needle 12 after the operation to the jog keys 323 are added to the X-axis direction offset value Xet and the Y-axis direction offset value Yet both in the offset information 5*b*.

Hence, the designation of the interested point, and the movement destination designation of the interested point can be easily input only by the operation given to the operation screen 324 and the jog key 323. Moreover, the positioning of the stitchwork pattern is facilitated because the offset information 5*b* is created in accordance with this input. That is, after this condition, in the execution of the sewing work, the reference point is changed from the origin position (X0, Y0) to the position (X0+Xet, Y0+Yet) apart therefrom by the shifted amount indicated by the offset information 5*b*, and the sewing starts from the first seam to the point corresponding to the apart distance indicated by the position information 51 on the first seam from the shifted position.

Modified Example

As described above, although the offset setting unit 43 creates the offset information 5*b* separately from the stitchwork data 5*a* and the sewing machine 1 starts sewing by shifting the stitchwork frame 26 by the shifted amount indicated by the offset information 5*b*, the stitchwork data 5*a* itself may be shifted instead of the stitchwork frame 26.

That is, the offset setting unit 43 adds the offset information 5*b* to the position information 51 that indicates the first seam with respect to the stitchwork data 5*a* that relatively indicates the position information 51. The addition destination of the difference is the stitchwork data 5*a* in the stitchwork data memory unit 45. Hence, the position of the stitchwork image 62 on the operation screen 324 is also updated. In this case, it is not necessary for the sewing machine 1 to refer to the offset information 5*b* at the time of the creation of the stitchwork image 62 and the execution of the sewing work.

Figure 14:
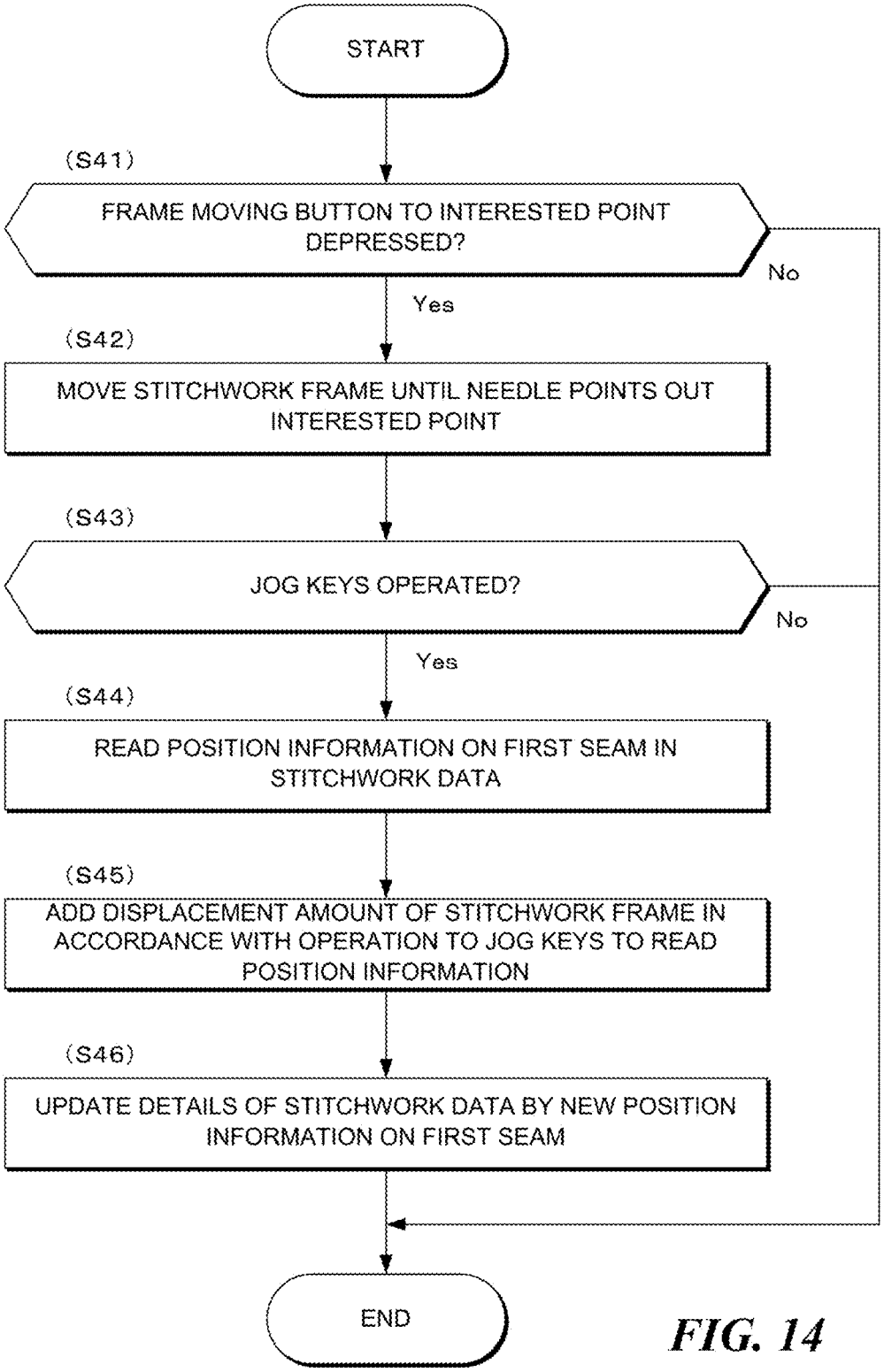
FIG. 14 is a flowchart illustrating a correction operation on stitchwork data.

FIG. 14 is a flowchart illustrating a correction operation of the stitchwork data 5*a* by the offset setting unit 43 according to this modified example. First, when the frame moving button 65 to the interested point displayed on the operation screen 324 is depressed using the touch panel 322 (step S41: YES), the stitchwork frame 26 is moved until the needle 12 points out the interested point determined by the user by this button depression (step S42).

After this step S42, when the user operates the jog keys 323 (step S43), the offset setting unit 43 reads the position information 51 on the first seam in the stitchwork data 5*a* (step S44), and adds the X-axis direction displacement amount and the Y-axis direction displacement amount of the movement of the stitchwork frame 26 in accordance with the operation given to the jog keys 323 to this position information 51 (step S45). The offset setting unit 43 updates the details of the stitchwork data 5*a* by this new position information 51 on the first seam (step S46).

In this case, it is assumed that the stitchwork data 5*a* on one flower attached to the cane from which the multiple leaves extend is stored in the stitchwork data memory unit 45. The stitchwork image 62 of this flower is displayed on the operation screen 324, enabling the user to know that the user designation point set under the flower is apart from the butterfly B already sewn, and the user wants to move the flower in such a way that the butterfly B is located at the tip of the leaf.

Figure 15A:
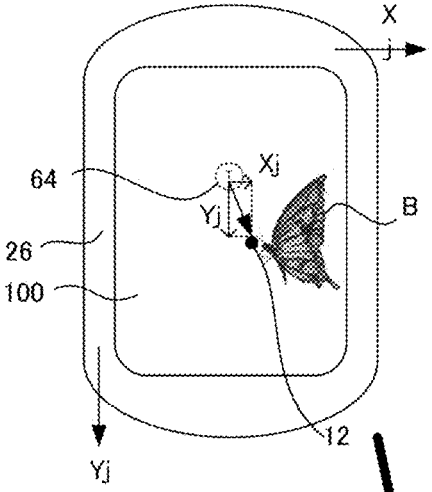
FIG. 15A to 15C are each an explanatory diagram illustrating another example of the jog key operation after the interested point is designated.
Figure 15B:
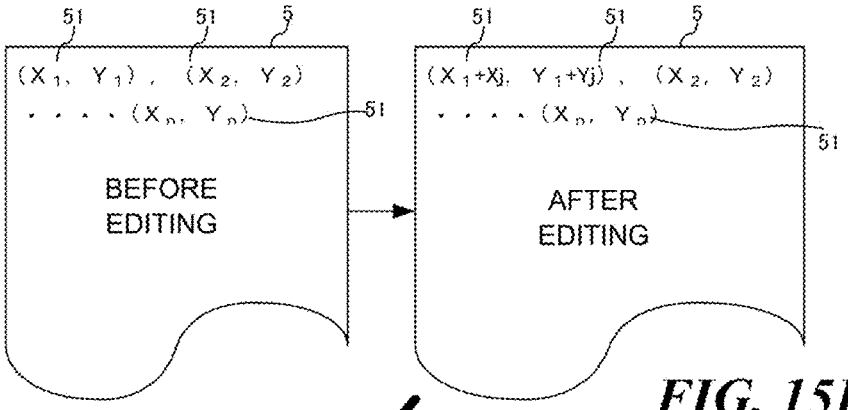

At this time, as illustrated in FIG. 15A, after the interested point is pointed out by the needle 12 by the depression of the frame moving button 65, when the jog keys 323 are operated until the needle 12 is located at the point to which the user wants to move the interested point, the stitchwork data 5*a* on the flower is edited in such away that the butterfly is located under the flower. That is, by the operation given to the jog keys 323, the position pointed out by the needle 12 changes from the location under the flower that is the interested point to the nearby location to the butterfly. As illustrated in FIG. 15B, the X-axis direction component Xj and Y-axis direction component Yi of this change amount are added to (X1, Y1) that is the original position information 51 on the first seam in the stitchwork data 5*a*.

Figure 15C:
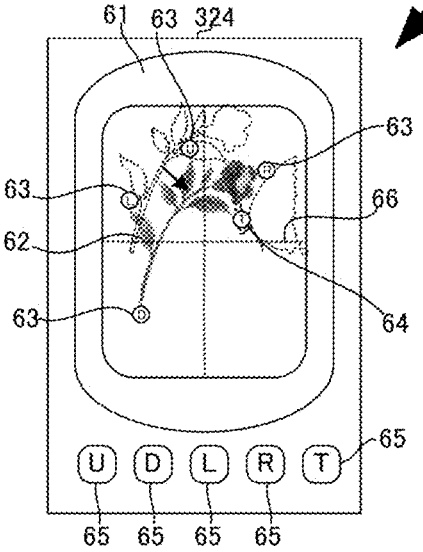

In this case, since the stitchwork data 5*a* is changed, as illustrated in FIG. 15C, the operation screen 324 displays the stitchwork image 62 of the shifted flower.

(Effect)

As described above, this sewing machine 1 includes the operation screen 324 that displays, in the screen region, the frame image 61 and the stitchwork image 62, and receives the user input of the interested point displayed within the stitchwork frame displayed in the screen region. Moreover, the stitchwork frame 26 is horizontally moved until the needle 12 points out the point within the stitchwork frame 26 and corresponding to the interested point. This enables the user to easily grasp the position of the user's interested point on the sewing object 100 without relying upon the user's imagination at all, improving the precision of the sewing preparation based on this interested point, thereby providing a sewing result with a high quality that can be satisfied by the user.

Moreover, the sewing machine 1 includes the jog keys 323 to receive the manual operation to the stitchwork frame 26. Furthermore, the operation screen 324 shifts the stitchwork image 62 within the screen region in accordance with the displacement amount from the point in the stitchwork frame 26 corresponding to the interested point to the point in the stitchwork frame 26 and pointed out by the needle 12 in accordance with the manual operation. This enables the user to grasp, by pre-view, how much offset of the stitchwork pattern from the reference position is necessary based on the grasped position of the interested point on the sewing object 100 in order to achieve a desired sewing form. Hence, a sewing result with a high quality that can be satisfied by the user is providable without relying upon the user's imagination and trial and error.

Moreover, the sewing machine 1 includes the offset setting unit 43 that calculates, based on the operation given to the jog key 323, the displacement amount from the point in the stitchwork frame 26 and corresponding to the interested point to the point in the stitchwork frame 26 and pointed out by the needle 12 in accordance with the manual operation. In addition, the offset setting unit 43 adds the displacement amount to the position information 51 on the first seam among the pieces of stitchwork data 5*a* that express the position information 51 on individual seams by the displacement amount from the last seam to the next seam. Alternatively, the displacement amount calculated by the offset setting unit 43 is stored as the offset information 5*b* in addition to the stitchwork data 5*a*, and the stitchwork frame 26 is horizontally moved in accordance with the offset information 5*b* before the needle 12 is fallen into the sewing object 100 when the sewing work is executed, and is horizontally moved in synchronization with the reciprocal motion of the needle bar 13 in accordance with the stitchwork data 5*a*.

The interested point designated by the user can serve as a reference for the user to grasp whether the interested point matches the user's desire. The difference between the interested point and the position desired by the user is stored as the offset information 5*b* in conjunction with the operation given to the jog keys 324, or is reflected on the stitchwork data 5*a*, enabling the user to easily match the position of the stitchwork pattern with the position desired by the user.

Moreover, the operation screen 324 further displays the frame image 61 of the stitchwork frame 26 in the screen region together with the stitchwork image 62. Accordingly, a preview with rich information is displayed, further reducing the reliance to the user's imagination, and thus a sewing result with a high quality that can be satisfied is providable.

Other Embodiments

Although the embodiments of the present disclosure have been described above, various omissions, replacements, and modifications can be made without departing from the scope of the present disclosure. Such embodiments and modified forms thereof are within the scope of the present disclosure, and are also within the scope of the invention as recited in the appended claims and the equivalent range thereto.

What is claimed is:

1. A sewing machine for sewing a stitchwork pattern on a sewing object, the sewing machine comprising:

a stitchwork frame horizontally moving along a direction in which a frame surface extends;

a needle bar supporting a needle to insert a thread, and reciprocally moving relative to an inner side of the stitchwork frame;

an operation screen displaying, in a screen region, an image of the stitchwork frame and an image of the stitchwork pattern, and receiving a user input of an interested point within the stitchwork frame displayed on the screen region, wherein the stitchwork frame is horizontally moved until the needle points out a point within the stitchwork frame corresponding to the interested point;

a jog key to receive input for controlling a manual movement operation of the stitchwork frame, wherein the operation screen shifts the image of the stitchwork pattern within the screen region in accordance with a displacement amount from the point within the stitchwork frame corresponding to the interested point to a point in the stitchwork frame pointed out by the needle in accordance with the manual movement operation, wherein, based on the input received by the jog key, a calculating unit calculates the displacement amount from the point in the stitchwork frame corresponding to the interested point to the point in the stitchwork frame pointed out by the needle in accordance with the manual movement operation;

a stitchwork data memory unit for storing stitchwork data containing a seam displacement amount from a last seam to a next seam; and an offset setting unit for calculating the seam displacement amount and adding the seam displacement amount to position information of a first seam.

2. The sewing machine according to claim 1, wherein the stitchwork data memory unit further stores offset information comprising the displacement amount calculated by the calculating unit, wherein the stitchwork frame is horizontally moved in accordance with the offset information, and is horizontally moved in synchronization with the reciprocal motion of the needle bar in accordance with the stitchwork data.

3. The sewing machine according to claim 1, wherein the operation screen displays a feature point on the image of the stitchwork pattern, and receives the feature point as the interested point.

4. The sewing machine according to claim 3, wherein the feature point is a location that facilitates a user to grasp a position of the stitchwork pattern and a dimension thereof.

5. The sewing machine according to claim 3, wherein the feature point is a leftmost end, a rightmost end, an uppermost end, or a lowermost end of the stitchwork pattern.

6. The sewing machine according to claim 3, further comprising a feature point extracting unit extracting the feature point.

7. The sewing machine according to claim 1, wherein the operation screen receives, as the interested point, a designation point on the operation screen touched by the user.

8. The sewing machine according to claim 1, wherein the operation screen further displays the image of the stitchwork frame in the screen region together with the image of the stitchwork pattern.

* * * * *